United States Patent [19]

Kersusan et al.

[11] Patent Number: 5,057,655

[45] Date of Patent: Oct. 15, 1991

[54] ELECTRICAL CIRCUIT BREAKER WITH SELF-EXTINGUISHING EXPANSION AND INSULATING GAS

[75] Inventors: Jean-Pierre Kersusan, Grenoble; Hugues Filiputti, Monestier de Clermont; Victor Pennucci, Seyssinet Pariset; Peter Malkin, Grenoble, all of France

[73] Assignee: Merlin Gerin, Meylan, France

[21] Appl. No.: 493,768

[22] Filed: Mar. 15, 1990

[30] Foreign Application Priority Data

Mar. 17, 1989 [FR] France ..... 89 03642

[51] Int. Cl.[5] ..... H01H 33/915; H01H 9/44; H01H 33/18

[52] U.S. Cl. ..... 200/148 B; 200/147 R; 200/148 R

[58] Field of Search ..... 200/147 R, 148 R, 148 A, 200/148 B, 150 G

[56] References Cited

U.S. PATENT DOCUMENTS

| | | | |
|---|---|---|---|
| 4,697,055 | 9/1987 | Walter et al. | 200/148 B |
| 4,900,882 | 2/1990 | Bernard et al. | 200/147 R |

FOREIGN PATENT DOCUMENTS

| | | |
|---|---|---|
| 0042456 | 12/1981 | European Pat. Off. . |
| 0075668 | 4/1983 | European Pat. Off. . |
| 0080690 | 6/1983 | European Pat. Off. . |
| 0298809 | 1/1989 | European Pat. Off. . |
| 1891058 | 4/1964 | Fed. Rep. of Germany . |
| 812088 | 8/1981 | Fed. Rep. of Germany . |

*Primary Examiner*—J. R. Scott

*Attorney, Agent, or Firm*—Parkhurst, Wendel & Rossi

[57] ABSTRACT

An inside of tubular contacts of a self-extinguishing expansion $SF_6$-gas circuit breaker including guiding ribs arranged to oppose any vortex-effect swirling gas flow between a first extinguishing chamber and a second expansion chamber. The presence of these ribs improves the dielectric withstand of the circuit breaker, and prevents any arc restriking inside the contacts.

7 Claims, 2 Drawing Sheets

ELECTRICAL CIRCUIT BREAKER WITH SELF-EXTINGUISHING EXPANSION AND INSULATING GAS

BACKGROUND OF THE INVENTION

The invention relates to a self-extinguishing expansion electrical circuit breaker having a sealed enclosure filled with a high dielectric strength insulating gas, and housing one or more pole-units, each pole-unit comprising:

- a first extinguishing chamber designed to store insulating gas heated by an arc;
- a pair of contacts with relative axial translation movement comprising separable arcing contacts bounding a breaking gap in the first chamber;
- a tubular gas outflow duct, arranged inside at least one of the contacts to make the first extinguishing chamber communicate with the remaining volume of the enclosure forming the second gas expansion chamber.

A circuit breaker of this kind is described in the European patent document EP-A-298,809 the corresponding U.S. Patent is U.S. Pat. No. 4,900,882.

Tests have shown that the gas outflow via the ducts of the tubular contacts to the second expansion chamber can generate an ordered gas outflow, with spiral movement along the axis. The resulting Vortex effect then causes a variation of the gas density with the formation of a central zone of low density located in the vicinity of the axis of each tubular contact. This results in a decrease of the dielectric withstand, with risks of arc restriking inside the arcing contacts.

The object of the invention consists in improving the dielectric withstand of a circuit breaker with self-extinguishing expansion of the insulating gas.

SUMMARY OF THE INVENTION

The circuit breaker according to the invention is characterized by the fact that the outflow duct is equipped with guiding means arranged to oppose in the duct any swirling gas flow, notably of the Vortex type.

The gas flow guiding means can be formed by ribs or bosses arranged around the internal periphery of the tubular contacts.

The ribs can be radial or inclined in the opposite direction to the gas rotation movement.

The presence of these ribs or bosses channels the gas flow to generate a laminar or turbulent regime, defined in terms of the value of the Reynolds' number, and with a direction which is overall parallel to the axis.

A coil or permanent magnet can advantageously be incorporated in the extinguishing chamber to set the arc in rotation, enabling the arc to be extinguished faster.

BRIEF DESCRIPTION OF THE DRAWINGS

Other advantages and features will become more clearly apparent from the following description of an illustrative embodiment of the invention, given as a non-restrictive example only and represented in the accompanying drawings, in which.

DESCRIPTION OF THE PREFERRED EMBODIMENT

Figure 1:
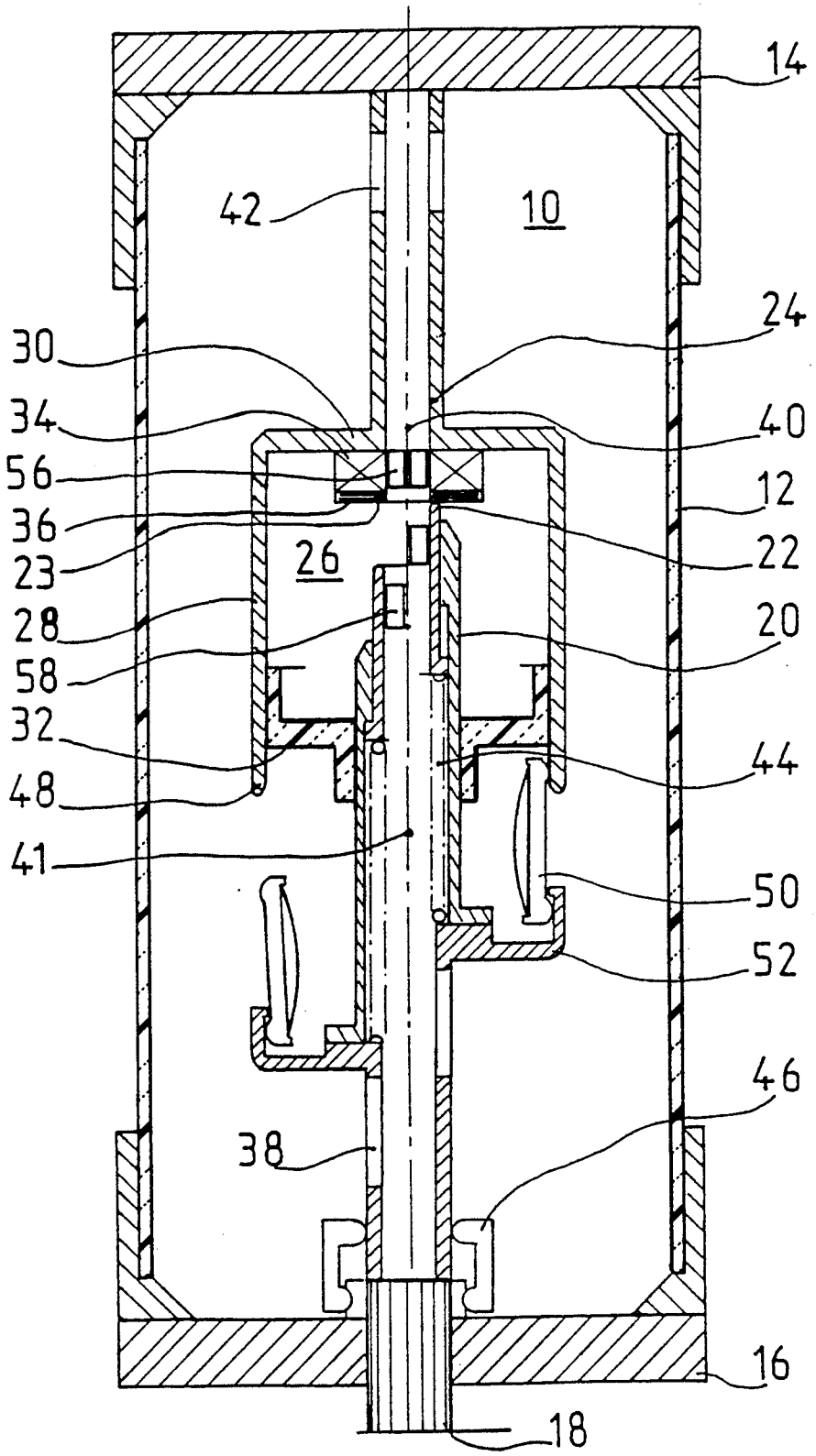
FIG. 1 is a schematic axial-sectional view of a self-extinguishing circuit breaker according to the invention, the left-hand half-view representing the open position, and the right-hand half-view the closed position.

In FIG. 1, the invention is described with respect to a medium or high voltage circuit breaker or switch described in the European patent document EP-A-298,809, but it is clear that it is applicable to any other type of self-extinguishing expansion circuit breaker.

The pole-unit comprises an enclosure 10 confined by a cylindrical casing 12, sealed at its ends by two base-plates 14, 16. The enclosure 10 is filled with a high dielectric strength gas, notably sulphur hexafluoride at atmospheric pressure or overpressure. The cylindrical casing 12 can be made of insulating material and the base-plates 14, 16 of conducting material constituting current input terminal pads. An operating rod 18, arranged in the axis of the enclosure 10, passes tightly through the base-plate 16 and is extended inside the enclosure 10 by a tubular movable contact 20. The tubular movable contact 20 bears at its end a movable arcing contact 22, cooperating with a stationary arcing contact 23 supported by the contact 24 fixed to the opposite base-plate 14. An extinguishing chamber 26, formed by a cylindrical surface 28 and two base-plates 30, 32, surround the contacts 22, 24 coaxially. The cylindrical surface 28 and the base-plate 30 are metallic and electrically connected to the stationary contact part 24. The opposite base-plate 32, through which the movable contact 20 passes, is made of insulating material ensuring electrical insulation between the movable contact 20 and the cylindrical surface 28.

Inside the extinguishing chamber 26 there is located a coil 34 fitted against the metal base-plate 30. The coil 34 is capped by an electrode 36 constituting an arc migration track arranged facing the movable arcing contact 22. The coil 34 is electrically connected both to the electrode 36 and to the base-plate 30 in such a way as to be inserted in series between the movable arcing contact 22 and the stationary contact part 24 in the closed position of the circuit breaker.

In the open position of the circuit breaker represented in the left-hand part of FIG. 1, the extinguishing chamber 26 communicates with the enclosure 10, which constitutes an expansion chamber, on the one hand by the tubular duct 41 of the movable contact 20 whose base has communicating orifices 38 between the tubular inside of the contact 20 and the enclosure 10, and on the other hand by the tubular-shaped stationary contact part 24, which is extended through the coil 34 by a central duct 40 and which communicates at its base by orifices 42 with the enclosure 10. The stationary arcing contact 23 is represented schematically on the internal annular edge of the electrode 36. In the closed position of the circuit breaker, represented in the right-hand half-view of FIG. 1, the movable arcing contact 22 is abutting on the electrode 36 sealing off the two outflow ducts constituted by the contacts 20, 24.

The movable arcing contact 22 is a semi-stationary telescopic contact biased by a spring 44 to the extension position. A sliding contact 46, supported by the base-plate 16 of the enclosure 10, cooperates with the movable contact 20 to ensure the electrical connection of this movable contact 20 and of the current input terminal pad formed by this base-plate 16.

The cylindrical surface 28 of the extinguishing chamber 26 is extended protruding beyond the insulating base-plate 32 by a flange 48 arranged as a stationary main contact. The stationary main contact 48 cooperates with a movable main contact 50 formed by a tulip-finger contact borne by a support 52 securedly united to the movable contact 20. The tulip-shaped contact fingers cooperate with the internal surface of the flange 48 in such a way as to respect the size of the extinguishing chamber 26, but it is clear that a reverse arrangement so as to encompass the flange 48 externally can be used when the dimensions of the main contacts are secondary.

Operation of a switch of this kind is well-known to those specialized in the art, and it is sufficient to recall that opening of the circuit breaker is controlled by downwards sliding in FIG. 1 of the operating rod 18 which drives the tulip-shaped main contact 50 downwards to a separation position of the stationary main contact 48. During the first phase of the circuit breaker opening movement, the telescopically-mounted movable arcing contact 22 remains in abutment on the electrode 36 due to the action of the spring 44. As soon as the main contacts 48, 50 separate, the current is switched to the parallel circuit formed by the movable arcing contact 22 and the coil 34. Opening of the main contacts 48, 50 takes place without an arc forming, and as soon as the current is switched to the parallel circuit, the coil 34 generates a magnetic field which contributes to extinguishing the arc formed when the arcing contacts 22, 36 separate in the course of the continued opening movement of the circuit breaker. The arc drawn in the extinguishing chamber 26 causes a heat rise and a pressure increase of the gas contained in this chamber, this gas escaping via the tubular contacts 20, 24 to the expansion chamber constituted by the enclosure 10. This results in a gas outflow which causes the arc to be blown out.

In the example described above, the coil 34 is switched into circuit as soon as the main contacts 48, 50 open, but it is clear that this switching into circuit can be achieved in a different way, notably by switching of the arc onto the electrode 36. The coil 34 can also be replaced by a permanent magnet and the gas outflow can take place via one of the contacts only.

According to the invention, at least one of the outflow ducts 40, 41 arranged in the stationary 24 and movable 20 tubular contacts comprises guiding means 56, 58 (see FIG. 1) of the gas flow escaping to the expansion chamber of the enclosure 10 during the arc extinguishing phase.

Figure 2:
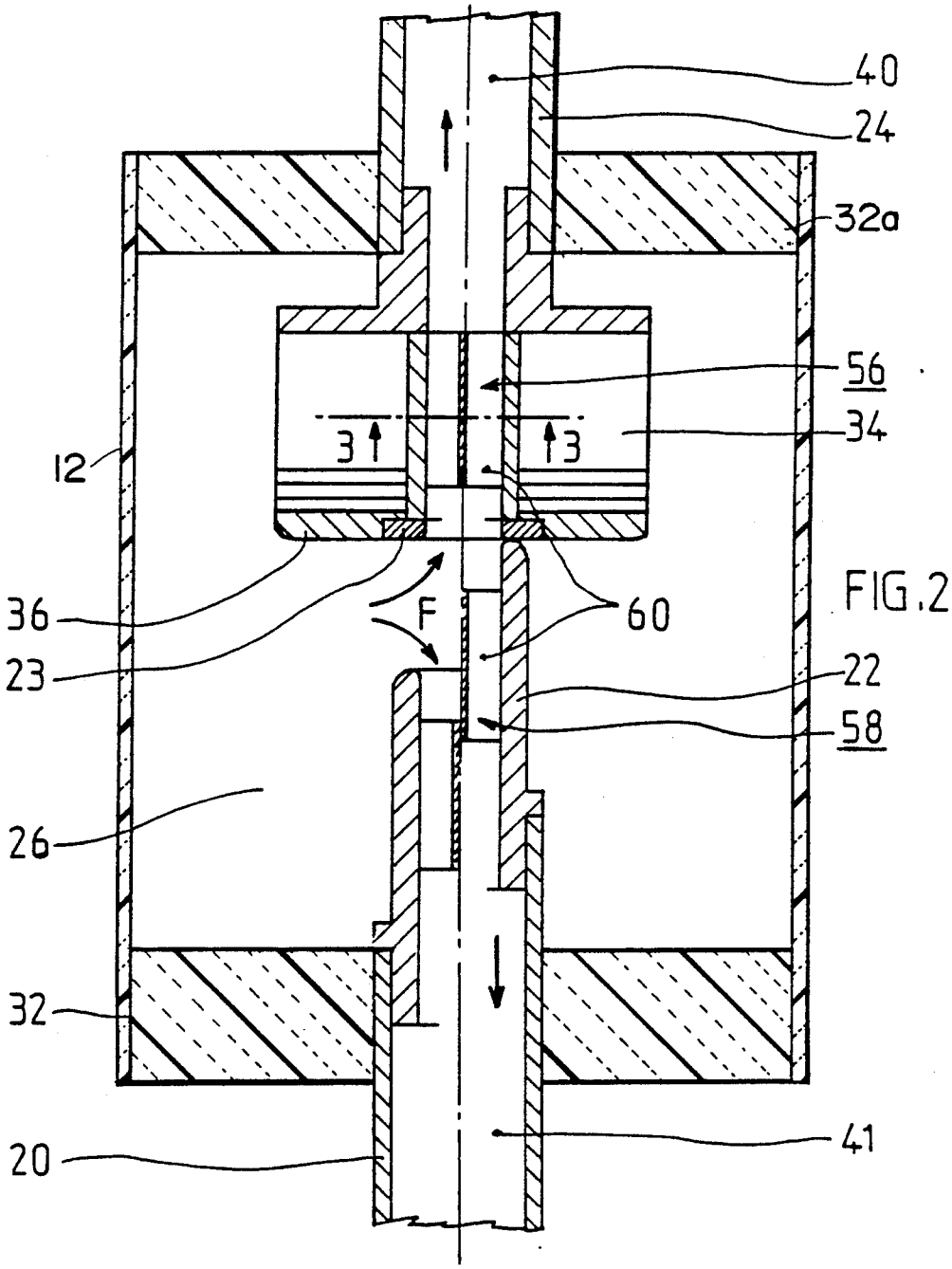
FIG. 2 is a detailed partial view of FIG. 1.

In FIG. 2, the guiding means 56 and 58 are formed by radial ribs securedly united to the cylindrical internal wall of the hollow arcing contacts 22, 23.

Figure 3:
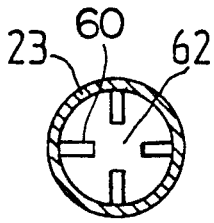
FIGS. 3 to 6 are sectional views along the line 3—3 of various alternative embodiments, concerning the gas flow guiding means in the tubular contacts.

FIG. 3 shows the guiding means 56 with four ribs 60 arranged at right angles along the cylindrical periphery of the support tube of the arcing contact 23. The four ribs 60 do not extend up to the center, so as to delimit a continuous central channel 62 at the inlet to the duct 40.

Figure 4:
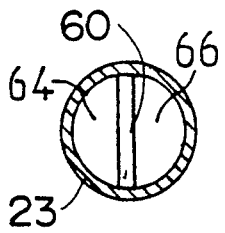

In FIG. 4, a single diametrical separating rib 60 subdivides the inside of the hollow contact 23 into two adjacent channels 64, 66.

Figure 5:
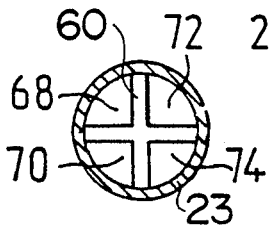

In FIG. 5, two diametrical ribs 60 are arranged in a cross to define four distinct channels 68, 70, 72, 74 at the inlet to the duct 40.

The ribs 60 and other guiding means 58 are identical to those described previously.

Figure 6:
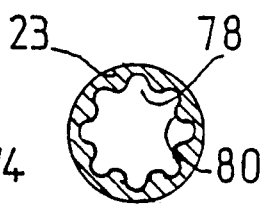

In the alternative embodiment in FIG. 6, the guiding means 56 comprises an alternating succession of grooves 78 and protuberances 80, arranged circumferentially along the internal tube of the arcing contact 23.

The function of these ribs 60 or protuberances 80 consists in channelling the gas axially in the ducts 40, 41 to prevent any swirling gas flow, notably of the Vortex type.

This results in a laminar or turbulent flow depending on the value of the Reynolds' number, which depends on the dimensioning and structure of the chamber 26 and arcing contacts 23, 22. The absence of ordered spiral movement of the outflow gas in the contacts (23, 22; 24, 20) contributes to regulating the density of $SF_6$ to improve the dielectric withstand and prevent any arc restriking inside the contacts.

In the alternative embodiments illustrated in FIGS. 2 to 6, the ribs 60 or protuberances 80 are made of conducting material.

The longitudinal position of the ribs 60 can be modified in terms of the ratings and breaking characteristics.

According to an alternative embodiment (not represented), the ribs 60 or protuberances 80 can be made of insulating material, and be of any shape, and notably be inclined in the opposite direction to the rotation movement of the gas.

The invention also applies to a self-extinguishing expansion circuit breaker without magnetic arc rotation means.

We claim:

1. A self-extinguishing expansion electrical circuit breaker including a sealed enclosure filled with a high dielectric strength insulating gas, and housing one or more pole-units, each of the pole units comprising:

a first extinguishing chamber disposed within the enclosure for storing insulating gas;

a pair of arcing contacts disposed in said first chamber which are axially translatable with respect to each other and define a breaking gap therebetween when separated in which an arc is formed;

a tubular gas outflow duct arranged inside at least one of said contacts for communicating said first chamber with a second chamber formed by a remaining volume of the enclosure disposed around said first chamber; and guiding means arranged on an interior of the duct for opposing Vortex-effect swirling gas flow therethrough.

2. The electrical circuit breaker of claim 1, wherein said guiding means comprises an alternating succession of grooves and protuberances arranged circumferentially along an internal wall of the duct.

3. The electrical circuit breaker of claim 1, wherein said duct is arranged along an axis of one of said contacts and includes orifices, opposite said contacts, which form passages to said second chamber.

4. The electrical circuit breaker of claim 1, wherein said first extinguishing chamber houses magnetic means for creating a magnetic field in the breaking gap to set the arc in rotation.

5. The electrical circuit breaker of claim 1, wherein said guiding means comprises at least one rib protruding from an internal wall of the duct.

6. The electric circuit breaker of claim 5, wherein said rib extends in a diametrical plane of the duct.

7. The electrical circuit breaker of claim 5, wherein said rib is inclined in a direction which is opposite to a rotational movement of the gas in said duct.

* * * * *